US009435090B1

(12) United States Patent
Bradburn et al.

(10) Patent No.: US 9,435,090 B1
(45) Date of Patent: Sep. 6, 2016

(54) GROOMER FOR FORMING LANES IN SNOW

(71) Applicant: Tube Shaper, LLC, McGaheysville, VA (US)

(72) Inventors: Marcus Cory Bradburn, McGaheysville, VA (US); Dennis Cale Neff, Seymour, TN (US)

( * ) Notice: Subject to any disclaimer, the term of this patent is extended or adjusted under 35 U.S.C. 154(b) by 94 days.

(21) Appl. No.: 14/101,938

(22) Filed: Dec. 10, 2013

Related U.S. Application Data

(60) Provisional application No. 61/736,171, filed on Dec. 12, 2012.

(51) Int. Cl.
*E01H 4/02* (2006.01)

(52) U.S. Cl.
CPC ..... *E01H 4/02* (2013.01)

(58) Field of Classification Search
CPC ..... E01H 4/00; E01H 4/02; E02F 3/7618
USPC ..... 34/223–225, 219, 220; 172/732, 765, 172/684.5
See application file for complete search history.

(56) References Cited

U.S. PATENT DOCUMENTS

| | | | | | |
|---|---|---|---|---|---|
| 286,969 | A | | 10/1883 | Smith | |
| 323,433 | A | | 8/1885 | Leeds | |
| 1,016,775 | A | * | 2/1912 | Ranney | 37/220 |
| 1,018,785 | A | | 2/1912 | Shank | |
| 1,331,382 | A | * | 2/1920 | Rolland | 172/247 |
| 1,345,532 | A | * | 7/1920 | Cass | 172/684.5 |
| 1,779,548 | A | * | 10/1930 | Lage | 172/618 |
| 2,197,307 | A | * | 4/1940 | Jenkins | 37/277 |
| 3,106,969 | A | * | 10/1963 | Carter | 172/684.5 |
| 3,123,155 | A | * | 3/1964 | Okawaki et al. | 172/722 |
| 3,478,827 | A | * | 11/1969 | Madson | 172/379 |
| 3,685,404 | A | | 8/1972 | Rich et al. | |
| 3,915,239 | A | * | 10/1975 | Hendrichon | 172/146 |
| 4,014,116 | A | * | 3/1977 | Baechler | 37/263 |
| 4,019,268 | A | | 4/1977 | Waterman | |
| 4,110,919 | A | * | 9/1978 | Henrichon | 37/219 |
| 4,122,614 | A | * | 10/1978 | Cheney | 37/219 |
| 4,479,312 | A | * | 10/1984 | Turgeon | 37/219 |
| 4,651,451 | A | | 3/1987 | Beeley et al. | |
| 4,756,100 | A | * | 7/1988 | Holden | 37/220 |
| 5,016,366 | A | * | 5/1991 | Watson | 37/220 |
| 5,067,264 | A | * | 11/1991 | Beeley | 37/222 |
| 5,960,890 | A | * | 10/1999 | Crain | 172/166 |

(Continued)

*Primary Examiner* — Robert Pezzuto
*Assistant Examiner* — Jessica H Lutz
(74) *Attorney, Agent, or Firm* — Charles S. Sara, Esq.; DeWitt Ross & Stevens SC

(57) ABSTRACT

A tow-behind snow groomer for forming lanes with barrier mounds (in tubing parks or on ski slopes) includes first and second pans having bottom panels, with front panels and inner panels extending upwardly from the bottom panels, respectively. A central chamber between the first and second pans includes a chamber upper panel bridging the first and second pan inner panels. The groomer can be secured to a vehicle via a vehicle mounting plate. When the groomer is driven over snow, the groomer displaces snow such that the first and second pans form first and second lanes, respectively, with the central chamber forming a central mound between the first and second lanes. First and second wings facilitate formation of peripheral mounds. The central and peripheral mounds are at higher elevations than both the first and second lanes, helping tubers stay in one lane without crossing into other lanes.

21 Claims, 4 Drawing Sheets

(56) References Cited

U.S. PATENT DOCUMENTS

| | | | | |
|---|---|---|---|---|
| 6,026,600 | A * | 2/2000 | Lela | 37/219 |
| 6,094,845 | A * | 8/2000 | Lela | 37/219 |
| 6,328,114 | B1 * | 12/2001 | Ritchie et al. | 172/445.1 |
| 6,351,899 | B1 * | 3/2002 | Slutzky | 37/223 |
| 6,516,543 | B1 * | 2/2003 | Bishop et al. | 37/219 |
| 6,810,609 | B2 | 11/2004 | Lassonde et al. | |
| 6,843,001 | B2 * | 1/2005 | Jenne | 37/93 |
| 2003/0051376 | A1 * | 3/2003 | Lassonde et al. | 37/348 |
| 2006/0283052 | A1 | 12/2006 | Kremer | |

* cited by examiner

GROOMER FOR FORMING LANES IN SNOW

CROSS-REFERENCE TO RELATED APPLICATIONS

This application claims priority under 35 USC §119(e) to U.S. Provisional Patent Application 61/736,171 filed Dec. 12, 2012, the entirety of which is incorporated by reference herein.

FIELD OF THE INVENTION

This document concerns an invention relating generally to the formation of lanes in snow, and more specifically to an apparatus that can be secured to a motor vehicle to form tubing lanes separated by mounds when passed over snow.

BACKGROUND OF THE INVENTION

Snow tube lanes are generally separated by barriers that are of sufficient height to constrain the snow tubes. These barriers may be constructed in many ways. For example, in some tubing parks barriers are formed with bales of hay, which are placed along the sides of the lanes. This use of hay bales does not require a large initial investment, but is costly due to the need to continuously purchase hay bales and the need to hire additional personnel to see that the hay bales remain in place during operation. In other tubing parks the ground under the snow is formed into a barrier that is subsequently covered by snow. However this method requires a larger initial investment in construction and limits the area's ability to groom the tubing lanes using existing grooming equipment.

SUMMARY OF THE INVENTION

The invention, which is defined by the claims set forth at the end of this document, is directed to the formation of snow lanes which at least partially alleviates the aforementioned problems. A basic understanding of some of the features of preferred versions of the invention can be attained from a review of the following brief summary of the invention, with more details being provided elsewhere in this document. To assist in the reader's understanding, the following review makes reference to the accompanying drawings (which are briefly reviewed in the "Brief Description of the Drawings" section following this Summary section of this document).

Referring to FIGS. 1-4, exemplary snow groomers for forming tubing lanes 40 separated by snow mounds 50 are represented collectively by the numeral 10. The groomer 10 includes a first pan 100 having a first pan bottom panel 110, with a first pan front panel 120 and a first pan inner panel 130 extending upwardly from the first pan bottom panel 110. The exemplary groomer 10 also includes a second pan 300 having a second pan bottom panel 310, with a second pan front panel 320 and a second pan inner panel 330 extending upwardly from the second pan bottom panel 310. The first and second pans 100, 300 are situated on opposing sides of a central chamber 200, the chamber 200 including a chamber upper panel 210 bridging the first pan inner panel 130 and the second pan inner panel 330. A vehicle mounting plate 400 is used to secure the groomer 10 to a vehicle 30, as shown in FIG. 3. A vehicle 30 pulls the groomer 10 behind itself as the vehicle 30 moves forward. When the groomer 10 is driven over snow, the groomer 10 displaces snow such that the first pan 100 forms a first lane 40A and the second pan 300 forms a second lane 40B, with the central chamber 200 forming a central mound 50A between the first lane 40A and the second lane 40B. As shown in FIG. 4, because the mounds 50 are at higher elevations than lanes 40, tubers 60 tend not to cross over into other tubers' lanes.

Further advantages and features of the invention will be apparent from the remainder of this document in conjunction with the associated drawings.

DETAILED DESCRIPTION OF PREFERRED VERSIONS OF THE INVENTION

Figure 1:
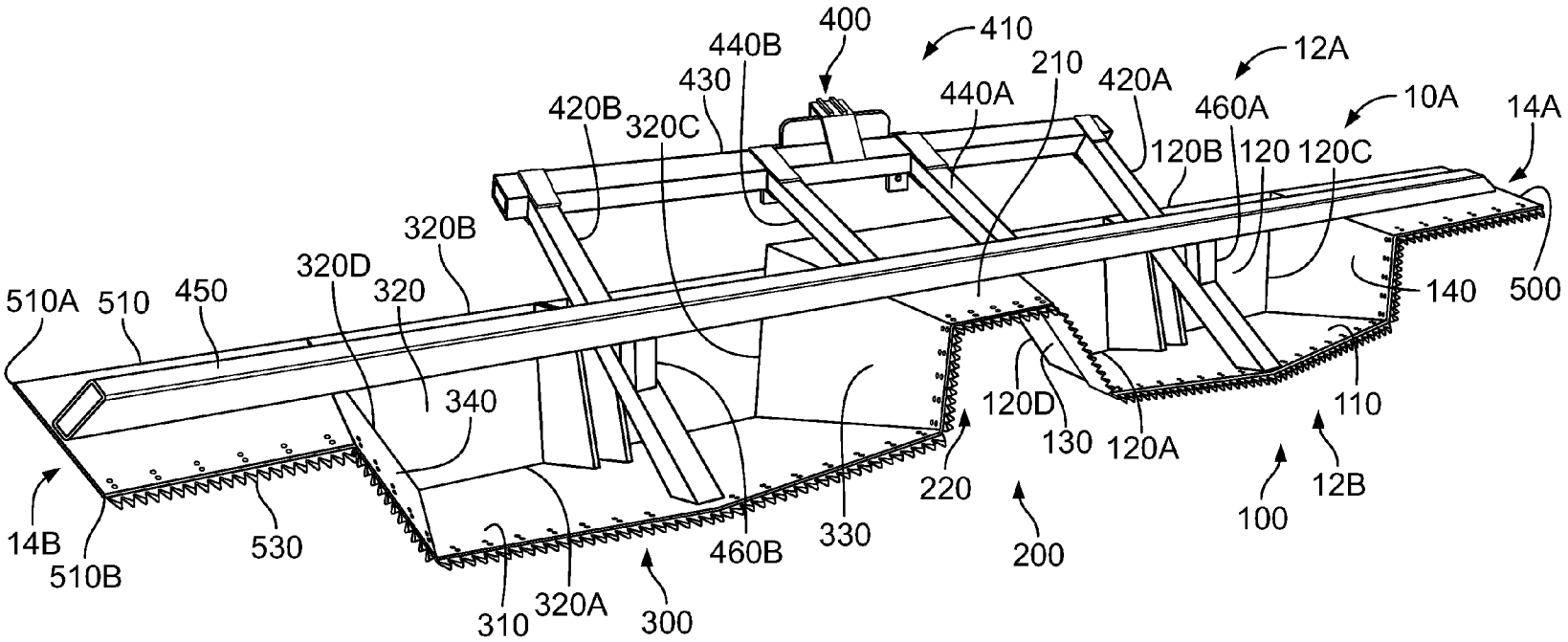
FIG. 1 is a perspective view of an exemplary snow groomer 10A with two pans 100, 300 on opposing sides of a chamber 200 shown from the back/top.

Returning to FIGS. 1 and 2, the groomer 10 (10A in FIG. 1, 10B in FIG. 2) has a groomer width extending laterally from a groomer front 12A to an opposing groomer rear 12B, and a groomer length extending longitudinally from a groomer first side 14A to an opposing groomer second side 14B. The groomer front 12A faces the vehicle 30 behind which the groomer 10 is being pulled, and it is the groomer front 12A that faces the snow to be displaced. The first pan front panel 120 and the second pan front panel 320 are both situated at the groomer front 12A. The first pan front panel 120 and the second pan front panel 320 may extend approximately perpendicularly upwards from the first pan bottom panel 110 and the second pan bottom panel 310, respectively. The first and second pan front panels 120, 320 have heights extending upwardly from first and second pan front panel bottoms 120A, 320A to first and second pan front panel tops 120B, 320B, respectively, and lengths extending from first and second pan front panel first ends 120C, 320C to first and second pan front panel second ends 120D, 320D. On opposing sides of the first pan bottom panel 110 are the first pan inner panel 130 and a first pan outer panel 140, and on opposing sides of the second pan bottom panel 310 are the second pan inner panel 330 and a second pan outer panel 340. In the version of FIG. 1, the first and second pan bottom panels 110, 310 are substantially pentagonal, whereas in the version of FIG. 2, the first and second pan bottom panels 110, 310 are substantially rectangular.

Between the first and second pans 100, 300 is the chamber 200, which is bordered in part by the first pan inner panel 130, the second pan inner panel 330, and the chamber upper panel 210, the chamber upper panel 210 at least partly bridging the first pan front panel 120 and the second pan front panel 320. The chamber 200 extends from a chamber rear opening 220 to a chamber front opening 230, which is at least partly defined by the first pan front panel second end 120D, the second pan front panel first end 320D, and the chamber upper panel 210. Because of the orientation of the first and second inner panels 130, 330 (which make a greater than 90 degree angle with the first and second pan front panels 120, 320), the chamber 200 is tapered such that the chamber front opening 230 is larger than the chamber rear opening 220. This facilitates the compacting of snow forming the mounds 50 between snow lanes 40: snow exiting the chamber 200 through the chamber rear opening 220 is more compact than snow entering the chamber 200 through the chamber front opening 230 because snow is funneled by the first and second pan inner panels 130, 330 when the groomer 10 is pulled behind vehicle 30. The first pan bottom panel 110 and the second pan bottom panel 310 extend longitudinally farther than the chamber upper panel 210, allowing the first lane 40A and the second lane 40B formed by the first pan 100 and the second pan 300, respectively, to be "wider" than the central mound 50A formed by the central chamber 200. Also, because the chamber upper panel 210 is positioned at a greater height (i.e., "above") the first and second pan bottom panels 110, 310, the first and second lanes 40A, 40B have greater "depth" in the groomed snow relative to the central mound 50A. The first and second lanes 40A, 40B have first and second lane depths, respectively, that are at least substantially equal to the first and second pan front panel heights, respectively.

The groomer 10 includes a mounting member 410 extending from the first and second pans 100, 300. The mounting member 410 may be U-shaped, with a mounting member first outer arm 420A and a mounting member second outer arm 420B bridged by a mounting member connecting arm 430. The mounting member first outer arm 420A extends upwardly and forwardly from the first pan bottom panel 110, and the mounting member second outer arm 420B extends upwardly and forwardly from the second pan bottom panel 310. The vehicle mounting plate 400 extends from the mounting member connecting arm 430. The groomer 10 may further include an elongated crossbar 450 extending from the groomer first side 14A to the groomer second side 14B. The mounting member 410 may further include a mounting member first inner arm 440A extending between the mounting member connecting arm 430 and the crossbar 450, and a mounting member second inner arm 440B extending between the mounting member connecting arm 430 and the crossbar 450. A crossbar first extender 460A may extend between the crossbar 450 and the mounting member first outer arm 420A, and a crossbar second extender 460B may extend between the crossbar 450 and the mounting member second outer arm 420B.

The groomer 10 further includes a first wing 500 and a second wing 510 extending in opposing directions from opposing sides of the groomer 10. The first wing 500 longitudinally extends from the first pan outer panel 140 at the groomer first side 14A, and the second wing 510 longitudinally extends from the second pan outer panel 340 at the groomer second side 14B, respectively. When the groomer 10 is driven over snow, the groomer 10 displaces snow such that a first peripheral mound 50B remains behind the first wing 500 and a second peripheral mound 50C remains behind the second wing 510 (see FIG. 3). Consequently the first lane 40A is formed with the first peripheral mound 50B and the central mound 50A on opposing sides thereof, and the second lane 40B is formed with the second peripheral mound 50C and the central mound 50A on opposing sides thereof. As with the central mound 50A, the first and second peripheral mounds 50B, 50C are at higher elevations than both the first lane 40A and the second lane 40B.

Figure 2:
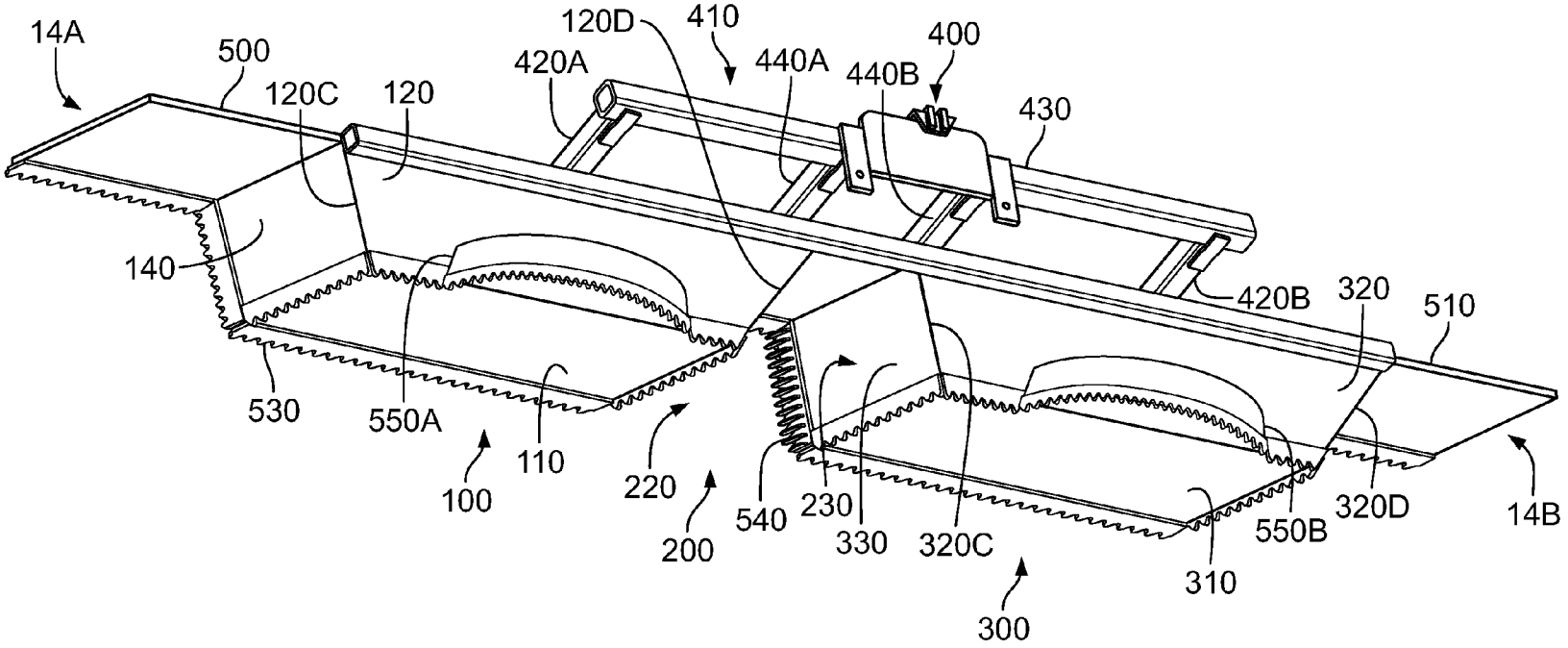
FIG. 2 is a perspective view of a second exemplary snow groomer 10B shown from the front/bottom.

The groomer 10 may further include teeth 530 extending forwardly, rearwardly, downwardly, and/or upwardly at various angles from one or more of the following: the first pan bottom panel 110 and/or the second pan bottom panel 310; the first pan front panel 120 and/or the second pan front panel 320; the first pan inner panel 130 and/or the first pan outer panel 140; the second pan inner panel 330 and/or the second pan outer panel 340; and/or the chamber upper panel 210. As shown in FIG. 2, the teeth 530 may be configured as a set of "blades" 540 or may extend from (for example) semi-circular extensions 550A, 550B from any suitable part of the groomer 10. The teeth 530 can be useful in scratching hard surfaces or breaking apart snow and ice as the groomer 10 is dragged over snow. The teeth 530 may also provide contour. For example, the teeth 530 may be placed on the trailing edge of the first and second pans 100, 300 to achieve a "corduroy" appearance (sometimes associated with freshly-groomed snow) resulting from teeth-marks 42 (see FIGS. 3 and 4).

To use the exemplary groomers 10A, 10B of FIGS. 1 and 2, a vehicle 30 may be driven to the bottom of a slope. The groomer 10 may be brought to a vehicle 30 capable of towing the groomer 10 by being secured thereto via a compatible vehicle mounting plate 400. A driver may then make a first pass by driving up the slope to form a first pair of lanes 40A, 40B bordered by first and second peripheral mounds 50B, 50C. The first and second wings 500, 510 are like "half chambers" that provide "incomplete" mounds on opposing sides of the first and second lanes 40A, 40B. To groom a second pair of lanes, the user may make a second pass by driving down the slope with the first wing 500 at least partly overlapping with the first peripheral mound 50B formed by the first pass. This may be repeated any number of times, with each pass providing an additional two lanes.

A preferred material for manufacturing the snow grooming device 10 is steel due to its high strength. However, the groomer 10 may be manufactured using other materials known in the art, provided the material is sufficiently strong/stable for the task.

Initially, it must be kept in mind that the snow groomers shown in the accompanying drawings and discussed above are merely exemplary, and may assume a wide variety of configurations different from those noted, and may use components different from those noted.

It should also be understood that various terms referring to orientation and position are used throughout this document—for example, "top" (as in "first and second pan front panel tops 120B, 320B"), "bottom" (as in "the first pan bottom panel 110 and the second pan bottom panel 310"), as well as "upper" and "above" (as in "the chamber upper panel 210 is positioned at a greater height (i.e., 'above')")—are relative terms rather than absolute ones. In other words, it should be understood (for example) that the panel tops being referred to may in fact be located at the bottom of the apparatus depending on the overall orientation of the apparatus. Thus, such terms should be regarded as words of convenience, rather than limiting terms.

Moreover, in the following description, it is to be understood that such terms as "forward," "rearward," "left," "right," "upwardly," "downwardly," and the like are words of convenience and are not to be construed as limiting terms.

Various preferred versions of the invention are shown and described above to illustrate different possible features of the invention and the varying ways in which these features may be combined. Apart from combining the different features of the foregoing versions in varying ways, other modifications are also considered to be within the scope of the invention. Following is an exemplary list of such modifications.

First, the groomer may be stripped down such that each of the first and second pans includes a front panel but does not have bottom panels, inner panels, and/or outer panels.

Second, an exemplary groomer may include a combination of various features from the versions shown in FIGS. 1 and 2. For example, a groomer may include shapes, angles, and relative dimensions derived from different aspects of the versions of FIGS. 1 and 2, or other altogether different versions.

Third, although FIG. 1 shows a crossbar 450 for strength and stability, this crossbar 450 is an optional part of the groomer 10 and not necessary.

Fourth, although the groomers of FIGS. 1 and 2 are shown with a vehicle mounting plate 400 extending from a U-shaped mounting member 410, the vehicle mounting plate 400 may be secured to the groomer 10 via any other suitable means.

Fifth, the number, dimensions, shapes, and placement of the teeth 530 shown in FIGS. 1 and 2 may be varied as deemed suitable. For example, teeth 530 may be eliminated, added, reoriented to point upwardly, downwardly, or at any angles desired so that the groomer 10 is suited for various applications or settings.

Figure 3:
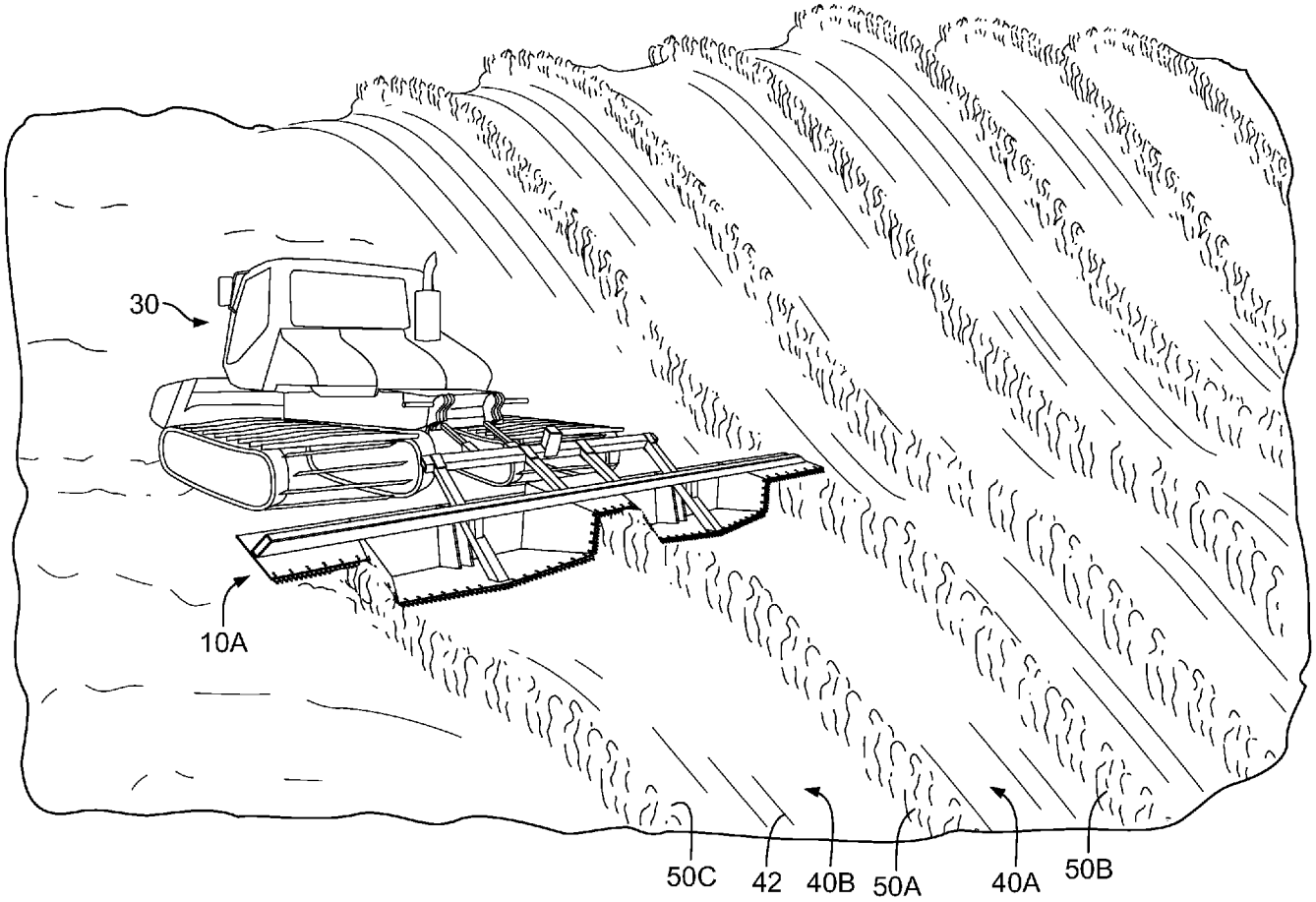
FIG. 3 shows the exemplary snow groomer 10A of FIG. 1 secured to the back of a vehicle 30 and being pulled to form snow tubing lanes 40A, 40B separated by mounds 50A, 50B, 50C.
Figure 4:
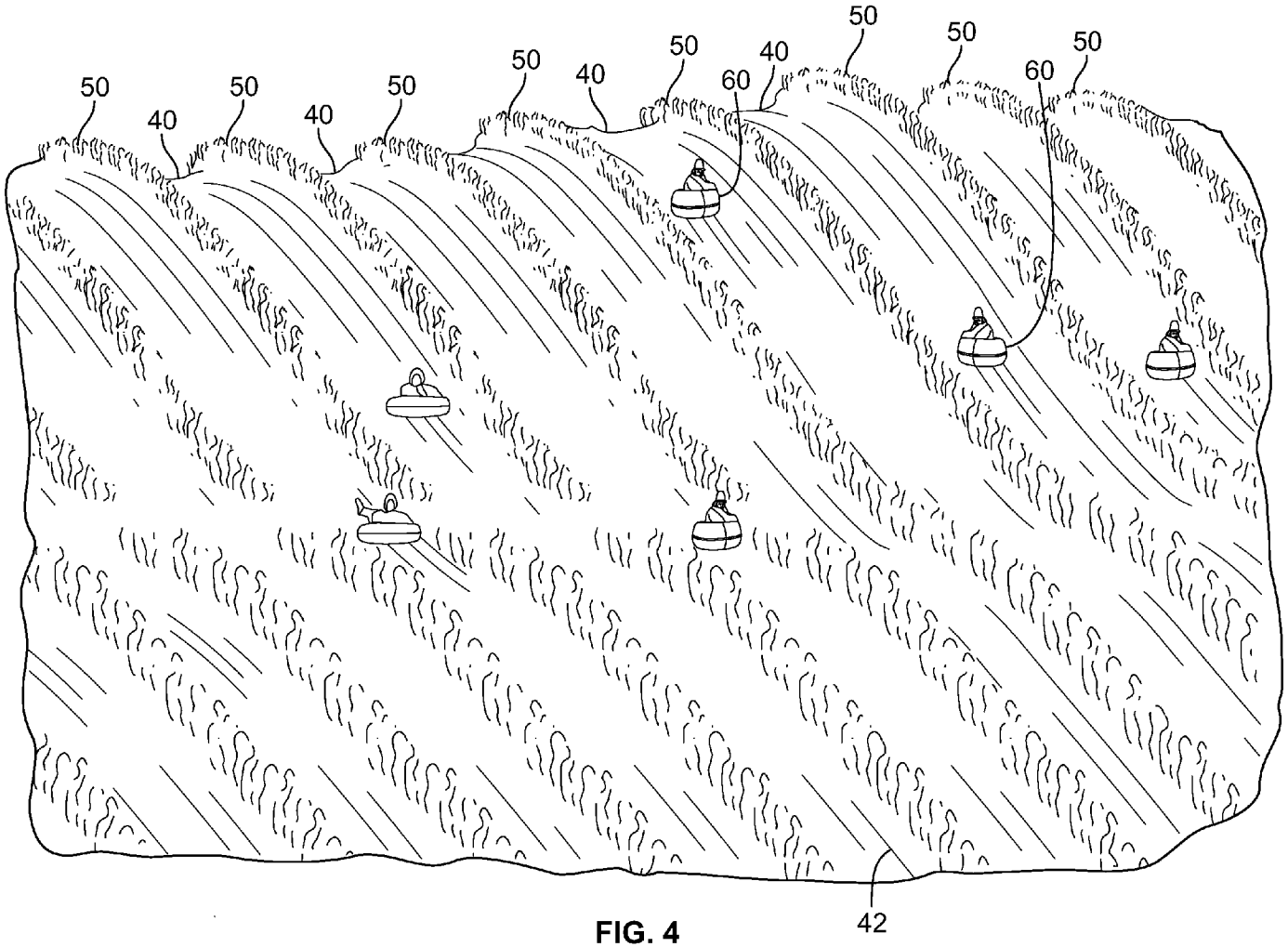
FIG. 4 shows a slope with multiple tubing lanes 40 formed using the snow groomer 10 of FIGS. 1-3, and multiple tubers 60 sliding down the lanes 40.

Sixth, although the exemplary versions of the groomer 10 discussed in this document describe the apparatus as a tow-behind device, the groomer 10 shown in FIGS. 1-3 could be reconfigured so that it operates by being pushed over snow rather than being pulled.

Seventh, although this document discusses the use of the groomer 10 in forming snow lanes for tubing, the apparatus could be used (with little or no modification) to form snow lanes suitable for other activities as well, such as snowboarding.

Eight, the relative angles, contours, and shapes of the various components of the groomer may be altered from what is shown in the Figures. For example, FIG. 1 shows that the second wing 510 that is angled such that a second wing front edge 510A is at a higher elevation than a second wing rear edge 510B. Such changes may be deemed suitable depending on the snow to be groomed, the terrain/slopes, and the particular configurations and appearances of the lanes and mounds being sculpted/formed.

The invention is not intended to be limited to the preferred versions of the invention described above, but rather is intended to be limited only by the claims set out below. Thus, the invention encompasses all different versions that fall literally or equivalently within the scope of these claims.

What is claimed is:

1. A snow groomer for forming tubing lanes separated by snow mounds, a) the groomer having:

i) a groomer width extending laterally from a groomer front to an opposing groomer rear;

ii) a groomer length extending longitudinally from a groomer first side to an opposing groomer second side;

iii) a first pan having:

1) a first pan bottom panel;

2) an at least substantially longitudinal first pan front panel extending upwardly from the first pan bottom panel; and 3) an at least substantially lateral first pan inner panel extending upwardly from the first pan bottom panel;

iv) a second pan having:

1) a second pan bottom panel;

2) an at least substantially longitudinal second pan front panel extending upwardly from the second pan bottom panel; and 3) an at least substantially lateral second pan inner panel extending upwardly from the second pan bottom panel;

v) a central chamber between the first pan and the second pan, the first and second pans being situated on opposing longitudinal sides of the central chamber, the chamber:

1) having a chamber upper panel bridging the first pan inner panel and the second pan inner panel;

2) being bordered by the first pan inner panel, the second pan inner panel, and the chamber upper panel, wherein the chamber upper panel rigidly bridges the first pan inner panel and the second pan inner panel; and 3) extending from a chamber front opening to a chamber rear opening; and vi) a vehicle mounting plate for securing the groomer to a vehicle;

b) wherein when the groomer is driven over snow, the groomer displaces snow such that:

i) the first pan forms a first lane and the second pan forms a second lane; and ii) the central chamber forms a central mound between the first lane and the second lane, the central mound being at a higher elevation than both the first lane and the second lane.

2. The snow groomer of claim 1 wherein at least one of the first pan front panel and the second pan front panel is situated at the groomer front.

3. The snow groomer of claim 1 wherein the first pan front panel and the second pan front panel are both situated at the groomer front.

4. The snow groomer of claim 1 wherein the first pan bottom panel, the second pan bottom panel, and the chamber upper panel are dimensioned such that a first lane and a second lane formed by the first pan and the second pan, respectively, are wider than a central mound formed by the central chamber.

5. The snow groomer of claim 1 further including a first wing and a second wing extending from opposing sides of the groomer.

6. The snow groomer of claim 5 wherein when the groomer is driven over snow, the groomer displaces snow such that a first peripheral mound remains behind the first wing and a second peripheral mound remains behind the second wing such that:

a) a first lane is formed with the first peripheral mound and the central mound on opposing sides thereof;

b) a second lane is formed with the second peripheral mound and the central mound on opposing sides thereof; and c) the first and second peripheral mounds are at higher elevations than both the first lane and the second lane.

7. The snow groomer of claim 5 further including a crossbar extending from the groomer first side to the groomer second side.

8. The snow groomer of claim 7 wherein the crossbar extends longitudinally from the first wing to the second wing.

9. The snow groomer of claim 7 further including a mounting member to which the vehicle mounting plate is secured, wherein the crossbar is secured to the mounting member.

10. The snow groomer of claim 9 wherein:

a) the mounting member is U-shaped, with a mounting member first outer arm and a mounting member second outer arm bridged by a mounting member connecting arm; and b) a first crossbar extender bridges the crossbar and the mounting member first outer arm, and a second crossbar extender bridges the crossbar and the mounting member second outer arm.

11. The snow groomer of claim 5 wherein:

a) the first wing extends longitudinally from the first pan outer panel at the groomer first side, and the second wing extends longitudinally from the second pan outer panel at the groomer second side, the first and second wings extending in opposing directions; and b) when the groomer is driven over snow, the first and second wings leave behind first and second peripheral mounds, the first and second peripheral mounds having higher elevations than both the first lane and the second lane.

12. The snow groomer of claim 1 further including teeth extending at least one of forwardly and rearwardly from one or more of the following:

a) at least one of the first pan bottom panel and the second pan bottom panel;

b) at least one of the first pan front panel and the second pan front panel;

c) at least one of the first pan inner panel and the first pan outer panel;

d) at least one of the second pan inner panel and the second pan outer panel; and e) the chamber upper panel.

13. The snow groomer of claim 1 wherein the chamber is tapered such that snow forming the central mound is at least partially compacted by the chamber.

14. The snow groomer of claim 1 wherein the chamber front opening is larger than the chamber rear opening such that snow exiting the chamber through the chamber back opening is more compact than snow entering the chamber through the front opening when the groomer is pulled behind a vehicle.

15. The snow groomer of claim 1 wherein:

a) a vehicle pulls the groomer behind itself as the vehicle moves forward with the groomer secured thereto via the vehicle mounting plate; and b) the groomer is configured such that the groomer front faces the vehicle behind which the groomer is being pulled.

16. The snow groomer of claim 1 further including a mounting member extending upwardly and forwardly from the groomer, wherein the vehicle mounting plate extends from the mounting member.

17. The snow groomer of claim 16 wherein the mounting member is U-shaped, having a mounting member first outer arm and a mounting member second outer arm bridged by a mounting member connecting arm, wherein:

a) the mounting member first outer arm extends upwardly and forwardly from the first pan bottom panel;

b) the mounting member second outer arm extends upwardly and forwardly from the second pan bottom panel; and c) the vehicle mounting plate extends from the mounting member connecting arm.

18. The snow groomer of claim 17 further including:

a) an elongated crossbar extending from the groomer first side to the groomer second side;

b) a mounting member first inner arm extending between the mounting member connecting arm and the crossbar; and c) a mounting member second inner arm extending between the mounting member connecting arm and the crossbar.

19. The snow groomer of claim 1, wherein:

a) each of the first pan inner panel and the second pan inner panel extends laterally from a rear edge to a forward edge; and b) the chamber upper panel extends laterally from the rear edges of the first and second pan inner panels to the forward edges of the first and second pan inner panels.

20. A snow groomer for forming tubing lanes separated by snow mounds, a) the groomer having:

i) a first pan including a first pan front panel with:

1) a first pan front panel height extending upwardly from a first pan front panel bottom to a first pan front panel top;

2) a first pan front panel length extending from a first pan front panel first end to a first pan front panel second end;

ii) a second pan including a second pan front panel with:

1) a second pan front panel height extending upwardly from a first pan front panel bottom to a first pan front panel top;

2) a second pan front panel length extending from a second pan front panel first end to a second pan front panel second end;

iii) a central chamber situated between the first pan and the second pan, the chamber having:

1) a chamber upper panel rigidly bridging the first pan front panel top and the second pan front panel top;

2) a chamber front opening at least partly defined by the first pan front panel second end, the second pan front panel first end, and the chamber upper panel;

iv) a mounting member that extends from the first and second pans; and v) a vehicle mounting plate for securing the groomer to a back of a vehicle, the vehicle mounting plate extending from the mounting member;

b) wherein when the groomer is pulled by a vehicle over snow:

i) snow passing through the chamber front opening forms a central mound separating the first lane and the second;

ii) the first pan front panel forms a first lane and the second pan front panel forms a second lane, 1) the first lane having a first lane depth that is at least substantially equal to the first pan front panel height, and 2) the second lane having a second lane depth that is at least substantially equal to the second pan front panel height.

21. A snow groomer for forming tubing lanes separated by snow mounds, a) the groomer extending:

i) laterally from a groomer front to an opposing groomer rear; and ii) longitudinally from a groomer first side to an opposing groomer second side;

b) the groomer including:
- i) a first pan having:
  - 1) a first pan bottom panel;
  - 2) a first pan front panel situated at the groomer front and extending upwardly from the first pan bottom panel; and
  - 3) a first pan inner panel and a first pan outer panel, the first pan inner and outer panels extending upwardly from the first pan bottom panel;
- ii) a second pan having:
  - 1) a second pan bottom panel;
  - 2) a second pan front panel situated at the groomer front and extending upwardly from the second pan bottom panel;
  - 3) a second pan inner panel and a second pan outer panel, the second pan inner and outer panels extending upwardly from the second pan bottom panel;
- iii) a central chamber between the first pan and the second pan, the first and second pans being situated on opposing longitudinal sides of the central chamber, the chamber:
  - 1) having a chamber upper panel bridging the first pan inner panel and the second pan inner panel;
  - 2) being at least partly bounded by the first pan inner panel, the second pan inner panel, and the chamber upper panel;
  - 3) extending from a chamber front opening to a chamber rear opening; and
  - 4) being tapered such that the chamber front opening is larger than the chamber rear opening;
- iv) a first wing extending longitudinally from the first pan outer panel at the groomer first side, and a second wing extending longitudinally from the second pan outer panel at the groomer second side; and
- v) teeth extending forwardly or rearwardly from one or more of the following:
  - 1) the first pan bottom panel;
  - 2) the second pan bottom panel;
  - 3) the first pan front panel;
  - 4) the second pan front panel;
  - 5) the first pan inner panel;
  - 6) the first pan outer panel;
  - 7) the second pan inner panel;
  - 8) the second pan outer panel; and
  - 9) the chamber upper panel;
- vi) a vehicle mounting plate for securing the groomer to a vehicle such that:
  - 1) the groomer front faces the vehicle; and
  - 2) the vehicle pulls the groomer behind as the vehicle moves forward;

c) wherein when the groomer is pulled behind a vehicle and driven over snow, the groomer displaces snow such that:
- i) a first lane is formed behind the first pan, and a second lane is formed behind the second pan;
- ii) a central mound is formed behind the chamber,
  - 1) the central mound:
    - (a) separating the first lane and the second lane; and
    - (b) being at a higher elevation than both the first lane and the second lane; and
  - 2) the central mound having snow that is at least partially compacted by the tapered chamber; and
- iii) a first peripheral mound remains behind the first wing and a second peripheral mound remains behind the second wing such that:
  - 1) the first lane is formed with the first peripheral mound and the central mound on opposing sides thereof;
  - 2) the second lane is formed with the second peripheral mound and the central mound on opposing sides thereof; and
  - 3) the first and second peripheral mounds are at a higher elevation than both the first lane and the second lane.

* * * * *